US010518997B2

(12) United States Patent
Nakai et al.

(10) Patent No.: US 10,518,997 B2
(45) Date of Patent: Dec. 31, 2019

(54) IMAGE FORMING APPARATUS

(71) Applicant: Sharp Kabushiki Kaisha, Sakai, Osaka (JP)

(72) Inventors: Yasuhiro Nakai, Sakai (JP); Masao Saeda, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 15/939,336

(22) Filed: Mar. 29, 2018

(65) Prior Publication Data

US 2018/0284684 A1 Oct. 4, 2018

(30) Foreign Application Priority Data

Mar. 31, 2017 (JP) ..... 2017-069718

(51) Int. Cl.
*B65H 31/00* (2006.01)
*G03G 15/00* (2006.01)

(52) U.S. Cl.
CPC ..... *B65H 31/00* (2013.01); *G03G 15/5016* (2013.01); *G03G 15/6552* (2013.01); *B65H 2405/11* (2013.01); *B65H 2405/12* (2013.01); *B65H 2551/18* (2013.01); *B65H 2551/212* (2013.01)

(58) Field of Classification Search
CPC ..... B65H 31/00; B65H 2301/4212; B65H 2405/10; B65H 2405/11; B65H 2405/12; B65H 2551/00; B65H 2551/10; B65H 2551/12; B65H 2551/18; B65H 2551/20; B65H 2551/21; B65H 2551/212; G03G 15/5016
See application file for complete search history.

(56) References Cited

U.S. PATENT DOCUMENTS

2008/0175640 A1 7/2008 Akiyama
2010/0091315 A1* 4/2010 Shiraki ..... G03G 15/5016 358/1.13
2010/0232857 A1* 9/2010 Nakayama ..... B65H 31/02 399/405
2012/0230748 A1* 9/2012 Okano ..... B41J 13/106 400/605

(Continued)

FOREIGN PATENT DOCUMENTS

CN 101231485 A 7/2008
CN 101833260 A 9/2010
JP 2007-264067 A 10/2007

*Primary Examiner* — Prasad V Gokhale
(74) *Attorney, Agent, or Firm* — Keating & Bennett, LLP

(57) ABSTRACT

An image forming apparatus is an in-body sheet discharge type image forming apparatus including an image forming portion and an image reading portion that is arranged above the image forming portion. The image forming apparatus comprises a sheet discharge tray and an operating panel. The sheet discharge tray is provided in an in-body sheet discharge portion between the image forming portion and the image reading station. On the sheet discharge tray, a sheet having been formed with an image by the image forming unit is discharged. The operating panel is provided on a front side of the sheet discharge tray. A part of a rear side of the operating panel overlaps with a sheet placement area having a front edge that is set on a front side compared to a rear end portion of the sheet discharge tray.

9 Claims, 5 Drawing Sheets

(56) References Cited

U.S. PATENT DOCUMENTS

| | | | | |
|---|---|---|---|---|
| 2015/0321878 | A1* | 11/2015 | Ichihashi | G03G 15/6508 271/3.19 |
| 2016/0154358 | A1* | 6/2016 | Hashimoto | B65H 31/20 271/213 |
| 2016/0289019 | A1* | 10/2016 | Kuroki | B65D 25/205 |
| 2017/0219976 | A1* | 8/2017 | Ito | G03G 15/5016 |

* cited by examiner

IMAGE FORMING APPARATUS

CROSS REFERENCE OF RELATED APPLICATION

The disclosure of Japanese patent application No. 2017-69718 filed on Mar. 31, 2017 is incorporated by reference.

BACKGROUND OF THE INVENTION

Field of the Invention

The present invention relates to an image forming apparatus, and more specifically, an in-body sheet discharge type image forming apparatus.

Description of the Related Art

An example of a related art is disclosed in Japanese patent application laying-open No. 2007-264067 [G03G 15/00] (Literature 1) laid-open on Oct. 11, 2007. An image forming apparatus disclosed in this Literature 1 is an in-body sheet discharge type image forming apparatus, comprising a reading portion that reads an image of an original, a discharge portion that is provided below the image reading portion and discharges a sheet having been printed, a stepped portion formed on a front side of the discharge portion, and an operating portion that is arranged on a front side of the stepped portion.

However, in the above-described image forming apparatus, since the stepped portion and the operating portion are arranged on the front side of the discharge portion, there is a problem that the image forming apparatus becomes large in a front and rear direction.

SUMMARY OF THE INVENTION

It is a primary object of the present invention to provide a novel image forming apparatus.

It is another object of the present invention to provide an image forming apparatus, capable of reducing a size in the front and rear direction.

A first embodiment is an in-body sheet discharge type image forming apparatus having an image forming portion and an image reading portion that is arranged above the image forming portion, comprising: a sheet discharge tray; and an operating portion. The sheet discharge tray is provided between the image forming portion and the image reading portion. A recording medium having been formed with an image by the image forming portion is discharged on this sheet discharge tray. The operating portion is provided on a front side of the sheet discharge tray. A part of a rear side of the operating portion overlaps with a sheet placement area that the recording medium discharged on the sheet discharge tray is placed. That is, a rear end portion of the operating portion is located on a rear side compared to a front edge of the sheet placement area. However, the sheet placement area means an area that when the largest recording medium used in the image forming apparatus is discharged to the sheet discharge tray, that recording medium exists therein.

According to the first embodiment, since a part of the rear side of the operating portion overlaps with the sheet placement area, it is possible to intend to reduce a size of a front and rear direction of the image forming apparatus. Moreover, according to the first embodiment, since the operating portion is provided on the front side of the sheet discharge tray, a distance from the front face of the image forming apparatus to the operating portion becomes short. Therefore, when a user with a low eyes level, such as a person who uses a wheelchair, a child, etc. uses the image forming apparatus, the user can easily operate the operating portion.

A second embodiment is the image forming apparatus according to the first embodiment, wherein a front edge of the sheet placement area is located on a front side compared to a front end portion of the sheet discharge tray.

According to the second embodiment, since the front edge of the sheet placement area becomes on the front side compared to the front end portion of the sheet discharge tray, it is possible to intend to miniaturize the image forming apparatus.

A third embodiment is the image forming apparatus according to the first embodiment, wherein the operating portion is provided on a front descending inclined portion formed between a sheet placement surface of the sheet discharge tray and the image forming portion.

According to the third embodiment, since the operating portion is provided on the front descending inclined portion formed between the sheet placement surface of the sheet discharge tray and the image forming portion, a user tends to visibly recognize the operating portion. Moreover, according to the third embodiment, since a size in a left and right direction of the operating portion can be made small compared to a case where the operating portion is arranged horizontally, it is intend to miniaturize a size in the front and rear direction of image forming apparatus.

A fourth embodiment is the image forming apparatus according to the first embodiment, wherein the sheet discharge tray has a protruding portion that protrudes toward a front side compared to a rear end portion of the operating portion in above the operating portion.

According to the fourth embodiment, it is possible to support a front end portion of the recording medium by the protruding portion. Therefore, it is possible to prevent the front end portion of the recording medium from drooping and to ensure visibility of the operating portion.

A fifth embodiment is the image forming apparatus according to the fourth embodiment, wherein the operating portion includes a display surface, and a front end portion of the protruding portion is located on a rear side compared to an imaginary surface that a contour of the display surface of the operating portion is extended in a vertical direction with respect to the display surface.

According to the fifth embodiment, since the front end portion of the operating portion is located on the rear side compared to a front face of the operating portion, when the user looks at the operating portion from the front, a line of sight of the user is not interrupted by the protruding portion. Therefore, even if the protruding portion is provided, the visibility of the operating portion can be secured.

A sixth embodiment is the image forming apparatus according to the first embodiment, wherein the operating portion is arranged on a downstream side in a sheet discharge direction on the front side of the sheet discharge tray.

According to the sixth embodiment, since the operating portion is arranged on the downstream side in the sheet discharge direction in the in-body sheet discharge portion, there is nothing that interrupts a line of sight of the user looking at the operating portion, the visibility of the operating portion is securable.

A seventh embodiment is the image forming apparatus according to the first embodiment, wherein a rear end portion of the operating portion is located on a rear side compared to the front end portion of the image reading portion.

According to the seventh embodiment, since the rear end portion of the operating portion is located on the rear side compared to the front end portion of the image reading portion, it is possible to miniaturize of the image forming apparatus in the front and rear direction.

An eighth embodiment is the image forming apparatus according to the first embodiment, further comprising a flat portion that is provided on a front side of the operating portion.

According to the eighth embodiment, since the flat portion that is provided on the front side of the operating portion, the user can operate the operating portion in a state where the user places his/her hand on the flat portion. That is, when operating an operating portion, the flat portion can be used instead of a handrail. Therefore, even when the user using the image forming apparatus is an elder person, a person with a disability in the body, a person using a wheelchair, a person who is injured or a person who is pregnant, etc., it is possible for such a person to operate the operating portion with a comfortable posture.

A ninth embodiment is the image forming apparatus according to the first embodiment, further comprising a tilt mechanism that supports the operating portion tiltably.

According to the ninth embodiment, since the operating portion is made tiltable by the tilt mechanism, it is possible to adjust an angle of the operating portion at an angle that the user tends to visibly recognize.

The above mentioned objects and other objects, features, aspects and advantages of the present invention will become more apparent from the following detailed description of the present invention when taken in conjunction with the accompanying drawings.

DETAILED DESCRIPTION OF NON-LIMITING EXAMPLE EMBODIMENTS

First Embodiment

Figure 1:
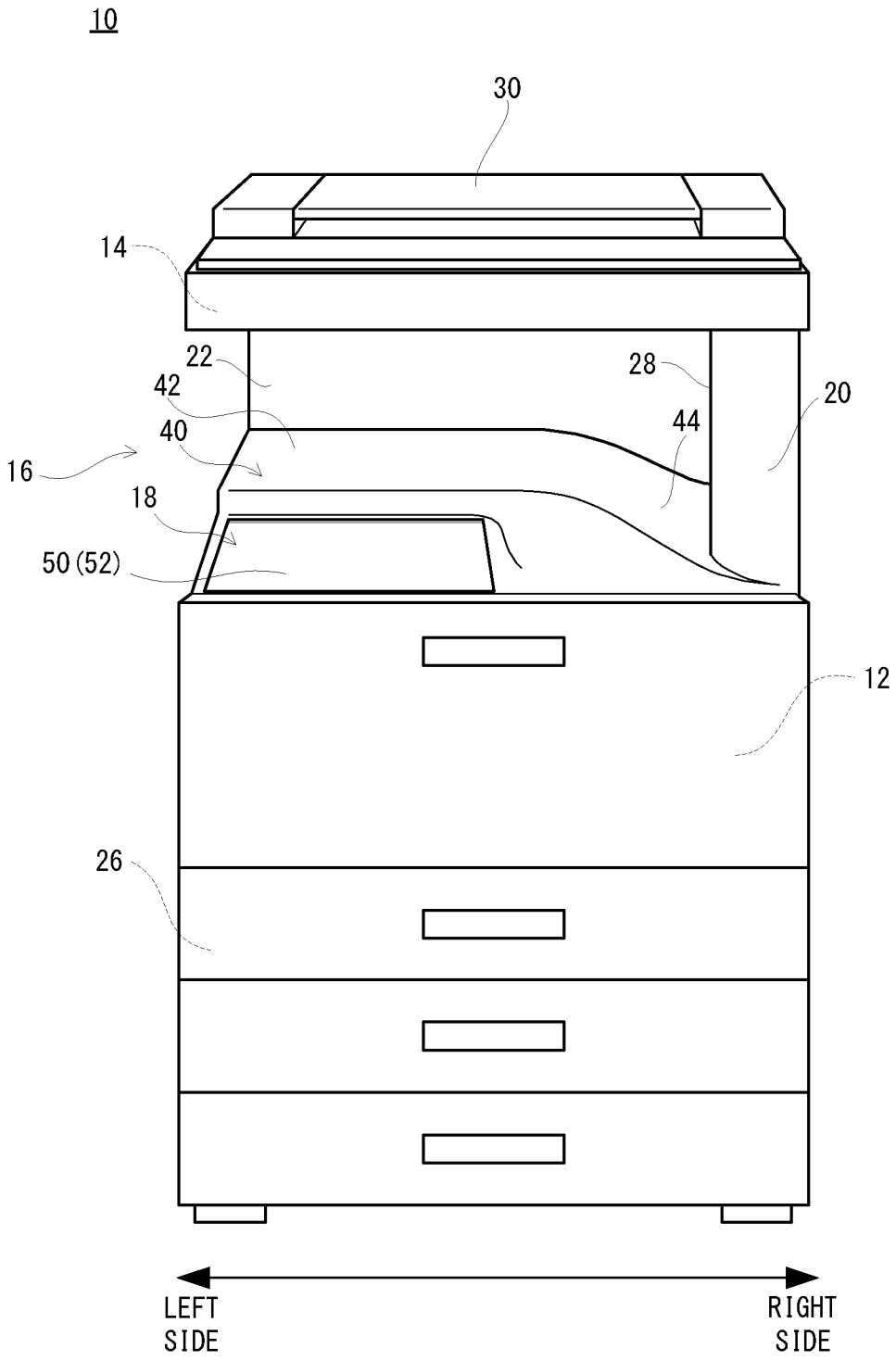
FIG. 1 is a front view showing an external configuration of an image forming apparatus that is an embodiment according to the present invention.

FIG. 1 is a front view showing an external configuration of an image forming apparatus 10 that is an embodiment according to the present invention.

With reference to FIG. 1, the image forming apparatus 10 that is one embodiment of the present invention is an in-body sheet discharge type image forming apparatus, which has an in-body sheet discharge portion 16 provided between an image forming portion 12 and an image reading portion 14. As described later, the image forming apparatus 10 forms a multicolor or monochromatic image on a predetermined sheet (recording medium) based on image data that is read by the image reading portion 14 or the like, and discharges the sheet having been formed with an image to the in-body discharge unit 16, and stores the sheet. In this first embodiment, the image forming apparatus 10 is a multifunction machine (MFP: Multifunction Peripheral) having a copying function, a printer function, a scanner function, a facsimile function, etc. Moreover, a recording medium is not limited to a sheet made of paper, and sheets other than paper, such as an OHP film, etc. are also used.

In addition, in this specification, on the assumption that a face opposite to a standing position of the user, that is, a face on a side provided with an operating panel (operating portion) described later is a front face (the front), a front and rear direction (depth direction) of the image forming apparatus 10 and its surroundings is defined, and a left and right direction (lateral direction) of the image forming apparatus 10 and its surroundings is defined on the basis of a state that the image forming apparatus 10 is viewed from the user.

At first, basic structure of the image forming apparatus 10 will be described. As shown in FIG. 1, the image forming apparatus 10 comprises an image forming portion 12 and an image reading portion 14 arranged above the image forming portion 12. The image forming portion 12 includes a first coupling housing 20 that is formed in a right upper portion and a second coupling housing 22 that is formed in a rear upper portion, and the image reading portion 14 is supported by these first coupling housing 20 and the second coupling housing 22. Thus, there is formed below the image reading portion 14 with an in-body space that is used as the in-body sheet discharge portion 16 storing the sheet having been formed with the image.

The image forming portion 12 comprises an exposure unit, a developer, a photoreceptor drum, a charger, an intermediate transfer belt, a transfer roller, a fixing unit, etc. The image forming portion 12 forms, with an electrophotography system, an image on a sheet that is fed from a sheet feed cassette 26 etc. arranged below the image forming portion 12. That is, the image forming portion 12 forms an electrostatic latent image according to image data onto the photoreceptor drum by the charger, the exposure unit, etc., and the electrostatic latent image on the photoreceptor drum is visualized with a toner by the developer. Moreover, a toner image that is formed on the photoreceptor drum is transferred onto a sheet by the intermediate transfer belt, the transfer roller, etc., and the toner image that is transferred to the sheet is subjected to heat fixing. Then, the sheet having been formed with the image is discharged from a discharge port 28 that is formed in an upper portion of the first coupling housing 20 to the in-body sheet discharge portion 16. In addition, the image data for forming an image on a sheet may be image data that is read by the image reading portion 14, image data that is transmitted from an external computer, etc.

The image reading portion 14 comprises a housing that has an original platen formed of transparent material on its upper surface. In this housing, there are provided with a light source, a plurality of mirrors, a focusing lens, a line sensor, etc. The image reading portion 14 exposes a surface of an original by the light source, and leads a reflected light that is reflected from the surface of the original to the focusing lens by the plurality of mirrors. Then, the reflected light is focused onto photoreceptor elements of the line sensor by the focusing lens. The line sensor detects brightness and chromaticity of the reflected light that is focused onto the photoreceptor elements, thereby to produce image data based on an image of the original surface. As the line sensor, a CCD (Charge Coupled Device), a CIS (Contact Image Sensor), etc. may be used. Moreover, an original platen cover 30 is attached to the upper surface of the image reading portion 14 to be opened and closed freely via a hinge etc.

The in-body sheet discharge portion 16 includes a bottom surface and a top surface that are partitioned by the image forming portion 12 and the image reading portion 14, and a right side face is partitioned with the first coupling housing 20, and a rear face is partitioned with the second coupling housing 22. That is, the in-body sheet discharge portion 16 is opened at a front surface side and a left surface side, respectively. Moreover, although it is unclear from FIG. 1, the discharge port 28 through which the sheet having been formed with the image is discharged is formed in a left side surface of the first coupling housing 20. However, a size (length) of the discharge port 28 in the front and rear direction is set to be larger than a size in a width direction of a sheet when the largest sheet usable in the image forming apparatus 10 is fed through the image forming portion 12.

The sheet discharged from the discharge port 28 is discharged from a right side (side of the first coupling housing 20 in the left and right direction) toward a left side (opposite side to the first coupling housing 20 in the left and right direction).

The bottom surface of the in-body sheet discharge portion 16 is used as a sheet discharge tray 40 that receives the sheet discharged from the discharge port 28. An upper surface of the sheet discharge tray 40 functions as a sheet placement plane. The sheet discharge tray 40 includes a flat surface 42 and an inclined surface 44 continuous with the flat surface 42. The flat surface 42 of the sheet discharge tray 40 is formed on the left of the in-body sheet discharge portion 16. An end portion on a right side of the flat surface 42 in the sheet discharge tray 40 is located in the right of the center in the left and right direction of the in-body sheet discharge portion 16 (image forming apparatus 10). That is, a length in the left and right direction of the flat surface 42 of the sheet discharge tray 40 is longer than a length of a half of the left and right direction of the in-body sheet discharge portion 16 (image forming apparatus 10). The inclined surface 44 of the sheet discharge tray 40 is provided on the right side of the in-body sheet discharge portion 16, and descends toward the right side (side of the first coupling housing 20 or opposite side to the flat surface 42 in the left and right direction).

The sheet discharged from the discharge port 28 to the sheet discharge tray 40 slides down on the inclined surface 44 of the sheet discharge tray 40 toward the first coupling housing 20 due to its own weight.

Moreover, although illustration is omitted, a control portion that controls operations of respective components of the image forming apparatus 10 is provided in a predetermined position of the image forming apparatus 10. The control portion comprises a CPU, a memory, etc., and transmits signals to the respective components of the image forming apparatus 10 according to an input operation to the operating panel 18 by the user, and the like, thereby to cause the image forming apparatus 10 to perform various operations.

Subsequently, structure of the operating panel 18 will be described. The operating panel 18 includes a display (display portion) 52 with a touch panel 50. The operating panel 18 is formed in a shape of a laterally elongated substantially rectangular plate. A lateral width (length in the left and right direction) of the operating panel 18 is set to, for example, approximately a half of a lateral width of the image forming apparatus 10. However, a size of the operating panel 18 can be appropriately changed depending on a size of the display 52 with the touch panel 50, or the like, and is not particularly limited.

On the display 52 with the touch panel 50, software keys (buttons) for receiving various settings or printing instructions from the user, messages, etc. are displayed. As an example, a home screen is displayed on the display 52, which is a screen for selecting a desired job out of various kinds of jobs that the image forming apparatus 10 can perform. However, in this first embodiment, the job means copying (including scanning of the original), printing, facsimile transmission, etc.

In addition, the software key means, for example, a key that is reproduced by software on a display surface of the display 52 with touch panel 50.

The touch panel 50 is a general-purpose touch panel, and it is possible to use a touch panel of an arbitrary system such as an electrostatic capacitance system, an electromagnetic induction system, a resistance film system, an infrared system, etc. In this first embodiment, a touch panel of an electrostatic capacitance system is used as the touch panel 50, and the touch panel 50 is provided on the display surface of the display 52. However, a touch display that the touch panel 50 and the display 52 are integrally formed may be used. As the display 52, an LCD or EL (Electro-Luminescence) display, etc. can be used, for example.

The operating panel 18 is provided in the in-body sheet discharge portion 16. Specifically, the operating panel 18 is provided on the front side of the sheet discharge tray 40. If the operating panel 18 is thus provided on the front side of the discharge tray 40, there is an advantage that when a user with low eyes level such as a wheelchair user or a child uses the image forming apparatus 10, such a user can operate the operating panel 18 easily. However, if the operating panel 18 is provided on the front side of the sheet discharge tray 40, there is a problem that the image forming apparatus 10 becomes large in the front and rear direction.

Moreover, if the operating panel 18 is provided on the front side of the sheet discharge tray 40, the sheet placement area that the sheet discharged to the sheet discharge tray 40 is placed becomes far from the front of the image forming apparatus 10. Therefore, there is also a problem of being hard for the user to grasp the sheet discharged to the sheet discharge tray 40.

Then, in this first embodiment, it is configured that a part of the operating panels 18 overlaps with the sheet placement area that the sheet discharged by the sheet discharge tray 40 is placed.

Figure 2:
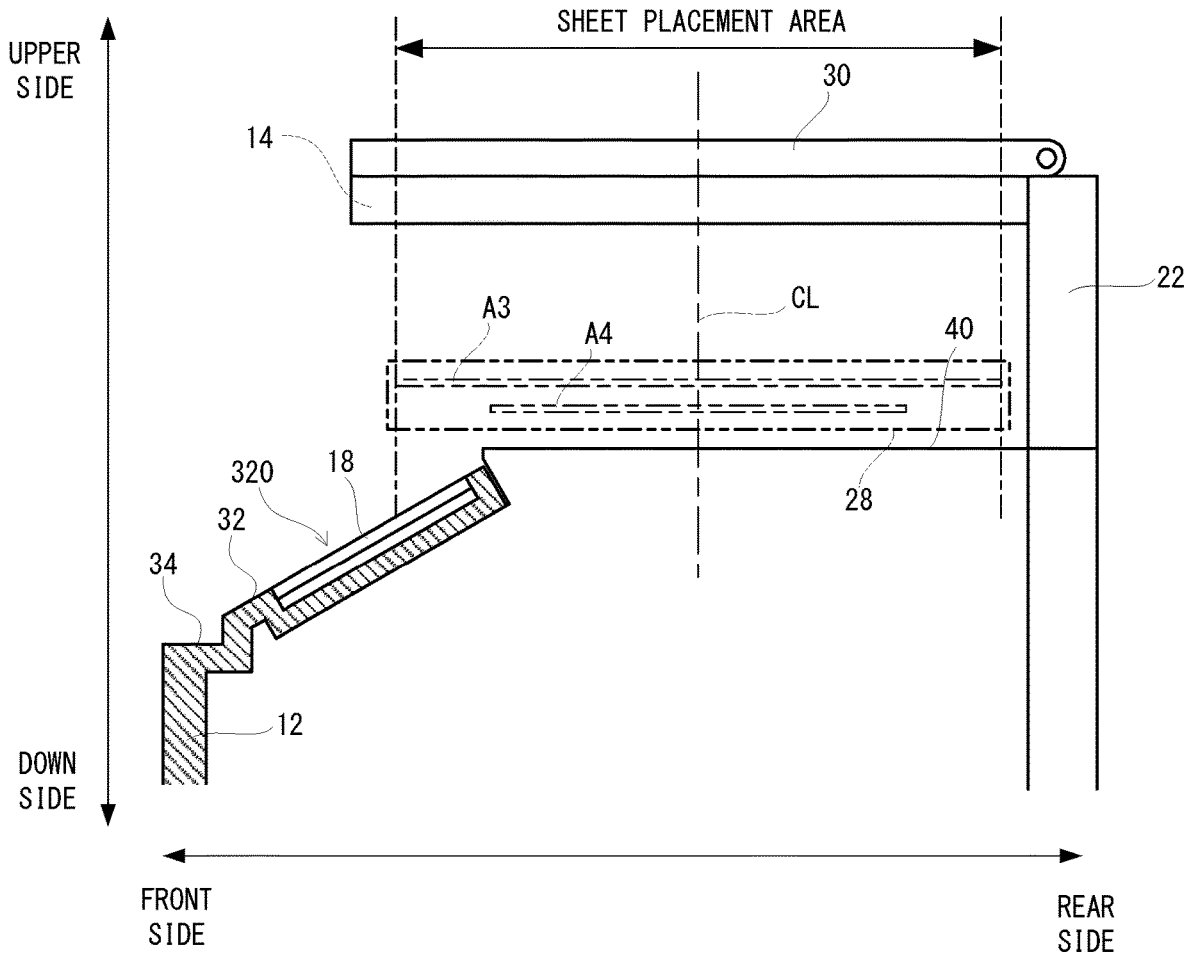
FIG. 2 is a schematic sectional view showing structure of an operating panel and its surroundings.
Figure 3:
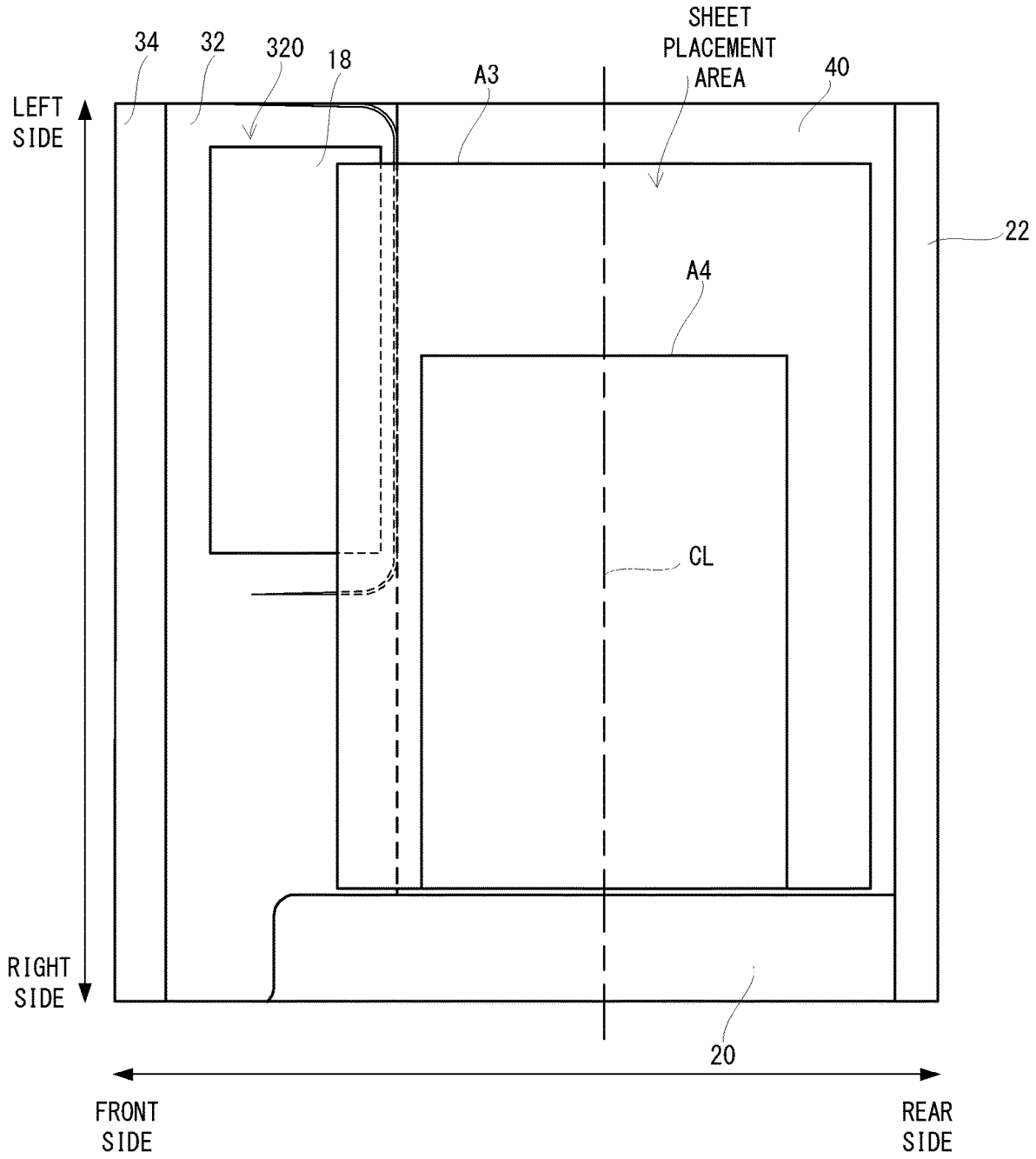
FIG. 3 is a schematic plan view showing structure of the operating panel and its surroundings.

FIG. 2 is a schematic sectional view showing the operating panel 18 and its surroundings. FIG. 3 is a schematic plan view showing the operating panel 18 and its surroundings. However, in FIG. 3, illustration of the image reading portion 14 and the original platen cover 30 is omitted.

As shown in FIG. 2, in the first embodiment, the operating panel 18 is arranged below the sheet discharge tray 40. Moreover, the operating panel 18 is arranged above the image forming portion 12. Therefore, the operating panel 18 is arranged between the sheet discharge tray 40 and the image forming portion 12.

Moreover, as shown in FIG. 2 and FIG. 3, the operating panel 18 is arranged on the left side (opposite to the first coupling housing 20 in the left and right direction) in the in-body sheet discharge portion 16 (image forming apparatus 10). This can also be said that the operating panel 18 is arranged on a downstream side in a sheet discharge direction in the in-body sheet discharge section 16.

Furthermore, a left end portion of the operating panel 18 is located in a left end portion of the in-body sheet discharge portion 16. Specifically, the left end portion of the operating panel 18 is located on slightly the right side compared to an end portion on a left side of the flat surface 42 of the sheet discharge tray 40 (see FIG. 1). Moreover, a right end portion of the operating panel 18 is located on the center in the left and right direction of the in-body sheet discharge portion 16. Specifically, the right end portion of the operating panel 18 is located on the left side compared to the end portion on a right side of the flat surface 42 of the sheet discharge tray 40 (see FIG. 1). Therefore, the operating panel 18 is located on the front (within a range in the left and right direction) of the flat surface 42 of the sheet discharge tray 40.

Moreover, the operating panel 18 is arranged in a position overlapping with a part of the sheet placement area, when viewed from the above. Specifically, a rear end portion of the operating panel 18 is located on a rear side compared to an end portion on the front side of the sheet placement area. However, the end portion on the front side of the sheet placement area is located on a front side compared to a front end portion of the sheet discharge tray 40. Here, the sheet placement area means an area that even when the largest sheet used in the image forming apparatus 10 is discharged to the sheet discharge tray 40, the sheet concerned can exist. For example, when the largest sheet used in the image forming apparatus 10 is an A3 size sheet, the sheet placement area is an area corresponding to the size of the A3 size sheet.

However, a sheet that is to be discharged to the sheet discharge tray 40 is discharged so that the center of the width direction (front and rear direction) of the sheet corresponds to a center reference line CL irrespective of a size of the sheet. Therefore, a position of the front and rear direction of the sheet placement area is set according to the center reference line CL. Specifically, a center position in the front and rear direction of the sheet placement area is set so as to overlap with the center reference line CL.

Moreover, as shown in FIG. 2, it is also can be said that the rear end portion of the operating panel 18 is located in the rear side compared to a front end portion of the discharge port 28. However, a size in the front and rear direction (width) of the discharge port 28 is set larger than the width of the largest sheet that is discharged from the discharge port 28. Therefore, the front end portion of the discharge port 28 is located on the front side compared to the end portion on the front side of the sheet placement area.

Furthermore, a rear end portion of the operating panel 28 is located on the rear side compared to a front end portion of the image reading portion 14. This can also be said that the front end portion of the image reading portion 14 is protruded toward the front side compared to the rear end portion of the operating panel 18.

Since a part of the operating panel 18 thus overlaps with the sheet placement area that the sheet discharged to the sheet discharge tray 40 is placed, when the width of the sheet discharged to the sheet discharge tray 40 is large, a part of the operating panels 18 may be covered with the sheet. When a size of a half of the width of the sheet discharged to the sheet discharge tray 40 is larger than a size from the center reference line CL of the sheet placement area to the front end portion of the sheet discharge tray 40, a part of the sheet protrudes from the front end portion of the sheet discharge tray 40. In such a case, a part of the rear side of the operating panel 18 is covered with the sheet. In the example shown in FIG. 2 and FIG. 3, when the size of the sheet discharged to the sheet discharge tray 40 is larger than the A4 size, a part of the rear side of the operating panel 18 may be covered with the sheet. On the other hand, when the size of the sheet discharged to the sheet discharge tray 40 is equal to or less than the A4 size, no part of the operating panels 18 is covered with the sheet.

Moreover, as shown in FIG. 2, the operating panel 18 is provided in parallel with an inclined portion 32 that is formed between the sheet placement surface of the sheet discharge tray 40 and the image forming portion 12. The inclined portion 32 ascends toward the rear side (descends toward the front side). For example, the inclined portion 32 inclines 20 (twenty) degrees with respect to the horizontal. Since the operating panel 18 is provided in parallel with this inclined portion 32, it is inclined to be ascended toward the rear side.

More specifically, the operating panel 18 is provided (fit) in a concave portion 320 formed in the inclined portion 32. The concave portion 320 is formed in a shape of a laterally elongated substantially rectangular so as to correspond to an external shape (contour) of the operating panel 18. Moreover, an upper surface around the concave portion 320 in the inclined portion 32 and a bottom surface of the concave portion 320 are parallel to each other. Therefore, the operating panel 18 is arranged so that an upper surface (display surface of the display 52) may be rendered parallel to the upper surface of the inclined portion 32. Furthermore, a size in a depth direction of the concave portion 320 is set to be slightly larger than a size in a thickness direction of the operating panel 18. Therefore, the upper surface (display surface of the display 52) of the operating panel 18 is located in a depth side (a down side or rear side) of the concave portion 320 compared to the upper surface of the inclined portion 32.

Furthermore, a flat portion 34 is provided on the front side of the operating panel 18. The flat portion 34 is a plane having an upper surface that is parallel to the original platen or an install surface of the image forming apparatus 10, that is, substantially horizontal plane. A size in the front and rear direction of the flat portion 34 is set to a size large enough to allow the user to put his/her hand (to touch the hand). For example, the size of the front and rear direction of the flat portion 34 is about 20 mm-40 mm. Moreover, the flat portion 34 is provided in the front of at least the operating panel 18 (range corresponding to the operating panel 18) in the left and right direction. However, the flat portion 34 may be provided throughout the left and right direction of the in-body sheet discharge portion 16 rather than only of the operating panel 18.

According to this first embodiment, since a part of the operating panel 18 overlaps with the sheet placement area that the sheet discharged to the sheet discharge tray 40 is placed, it is possible to intend to miniaturize the image forming apparatus 10 in the front and rear direction.

Moreover, according to the first embodiment, since the operating panel 18 is provided on the front side of the sheet discharge tray 40, when a user with a low eyes level uses the image forming apparatus 10, such a user tends to operate the operating panel 18.

Furthermore, According to the first embodiment, since the operating panel 18 is provided on the inclined portion 32 descending toward the front formed between the sheet discharge tray 40 and the image forming portion 12, it is possible for the user to visibly recognize the operating panel 18 easily. Moreover, since a size in the left and right (horizontal) direction of the operating panel 18 can be made to be small compared to a case where the operating panel 18 has been arranged horizontally, it is possible to intend to miniaturize the image forming apparatus 10 in the front and rear direction.

Furthermore, in the first embodiment, since the operating panel 18 is arranged on the downstream side of the sheet discharge direction in the in-body sheet discharge portion 16, it is possible to secure the visibility of the operating panel 18.

Moreover, according to the first embodiment, since the rear end portion of the operating panel 18 is located on the rear side comparted to the front end portion of the image reading portion 14, it is possible to intend to miniaturize the image forming apparatus 10 in the front and rear direction.

Furthermore, according to the first embodiment, since the flat portion 34 is provided on the front side of the operating panel 18, the user can operate the operating panel 18 in a state where the user places his/her hand on the flat portion 34. That is, when operating the operating panel 18, the flat portion 34 can be used instead of a handrail. Therefore, even when the user using the image forming apparatus 10 is an elder person, a person with a disability in the body, a person using a wheelchair, a person who is injured or a person who is pregnant, etc., it is possible for such a person to operate the operating portion with a comfortable posture.

Second Embodiment

In an image forming apparatus 10 of the second embodiment is the same as the image forming apparatus 10 of the first embodiment except that a part of the operating panel 18 is covered by a part of the sheet discharge tray 40, when viewed from the above, different contents will be described in detail, and description of duplicate contents will be omitted, or will be described briefly.

Figure 4:
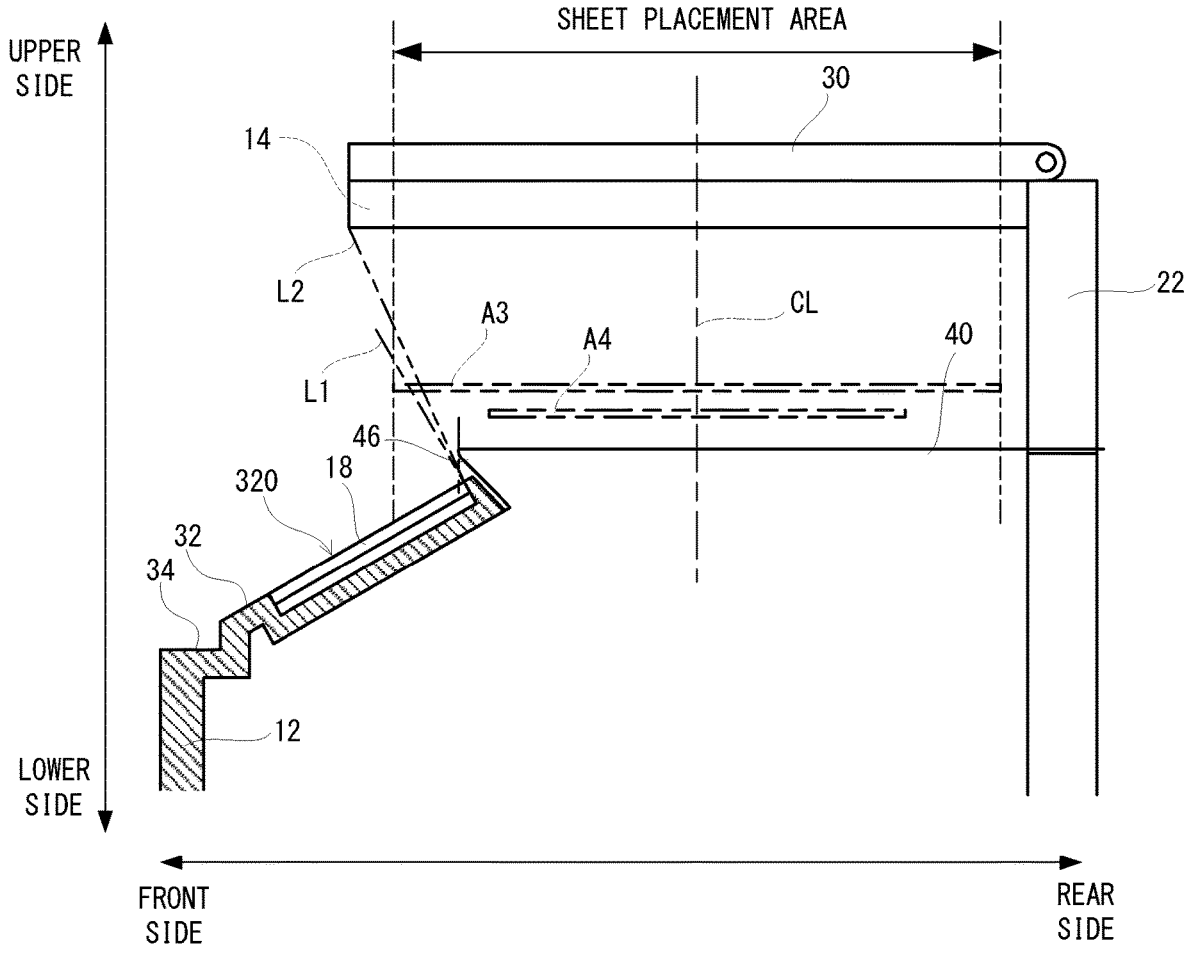
FIG. 4 is a schematic sectional view showing an operating panel of a second embodiment and its surroundings.

FIG. 4 is a schematic sectional view showing an operating panel 18 and its surroundings of the second embodiment. As shown in FIG. 4, in the second embodiment, the sheet discharge tray 40 has a protruding portion 46. The protruding portion 46 is located above the operating panel 18, and protruded toward the front side from an upper end portion on the front side of the sheet discharge tray 40.

Moreover, an upper surface of the protruding portion 46 is a surface continuous from the upper surface of the sheet discharge tray 40, that is, the same surface as the upper surface of the sheet discharge tray 40. A lower surface of the protruding portion 46 is inclined descending toward the rear side (ascending toward the front side). The upper surface of the protruding portion 46 and the lower surface of the protruding portion 46 intersect to each other to form a corner portion on the front side of the protruding portion 46. This corner portion of the front side of the protruding portion 46 is subjected to rounding processing (corner rounding) so as to become in a shape of a curved surface.

Furthermore, the protruding portion 46 is provided in a part of the sheet discharge tray 40 in the left and right direction. Specifically, the protruding portion 46 is provided in the front (within a range in the left and right direction) of the flat surface 42 of the discharge tray 40 in the left and right direction. On the other hand, the protruding portion 46 is not provided in the front of the inclined surface 44 of the sheet discharge tray 40 in the left and right direction.

A position of a front end portion of the protruding portion 46 is located on the front side compared to the rear end portion of the operating panel 18, i.e., protruded toward the front side. That is, the protruding portion 46 is protruded toward the front side compared to the rear end portion of the operating panel 18. Therefore, when viewing from the above (right above), a part of the rear side of the operating panel 18 is covered with the protruding portion 46. That is, a part of the front side of the sheet discharge tray 40 and a part of the rear side of the operating panel 18 overlap with each other.

However, a position of the front end portion of the protruding portion 46 is set to a position that does not interrupt a line of sight of the user who looks at the operating panel 18. For example, the position of the front end portion of the protruding portion 46 is set on the rear side compared to the display surface of the display 52, when viewing from a perpendicular direction to the upper surface (display surface of the display 52) of the operating panel 18. That is, the front end portion of the protruding portion 46 is located in the rear side compared to an imaginary surface (imaginary line L1 shown in FIG. 4) that a contour (external shape line) of the display surface of the display is extended in a vertical direction to the display surface. Moreover, the position of the front end portion of the protruding portion 46 is located on the rear side compared to an imaginary surface (imaginary line L2 shown in FIG. 4) that connects the front end portion of the image reading portion 14 and the rear end portion of the operating panel 18 to each other. In this way, when the user looks at the operating panel 18, the line of sight of the user is not interrupted by the protruding portion 46.

Moreover, the position of the front end portion of the protruding portion 46 may be set in the rear side compared to the line of sight of the user who looks at the rear end portion of the operating panel 18 while assuming a case of using the image forming apparatus 10 in a state where an adult user (a user with high eyes level) stands up. In this case, a direction of the line of sight of the user is set in advance. Then, the position of the front end portion of the protruding portion 46 is set to the rear side compared to the line of sight of the user in a case assuming that the user looks at a rear end portion of the display 52 of the operating panel 18. Therefore, when the operating panel 18 is viewed from the front in a state where an adult person is standing, the line of sight of the user is not interrupted by the protruding portion 46.

In addition, if the eyes level of the user becomes low, the protruding portion 46 is less likely to interrupt the line of sight of the user compared to when the eyes level of the user is high. Therefore, if the position of the front end portion of the protruding portion 46 is set according to the line of sight of the user whose the eyes level is high, the protruding portion 46 does not interrupt the line of sight of the user when a user whose the eyes level is low, such as a user who uses a wheelchair, a child uses the image forming apparatus 10.

According to this second embodiment, the end portion on the front side of the sheet that is discharged to the sheet discharge tray 40 is supported by the protruding portion 46. Therefore, since the end portion on the front side of the sheet becomes hard to droop, it is possible to make an area that the operating panel 18 is covered by the end portion on the front side of the sheet be small. Therefore, it is possible to ensure visibility of the operating panel 18.

Moreover, according to the second embodiment, since the position of the front end portion of the protruding portion 46 is set to the position that does not interrupt the line of sight of the user who looks at the operating panel 18, the line of sight of the user is not interrupted by the protruding portion 46. Therefore, it is possible to ensure visibility of the operating panel 18.

Third Embodiment

In an image forming apparatus 10 of the third embodiment is the same as the image forming apparatus 10 of the first embodiment except that it makes a tilt angle of the operating panel 18 be changeable, different contents will be described in detail, and description of duplicate contents will be omitted, or will be described briefly.

Figure 5A:
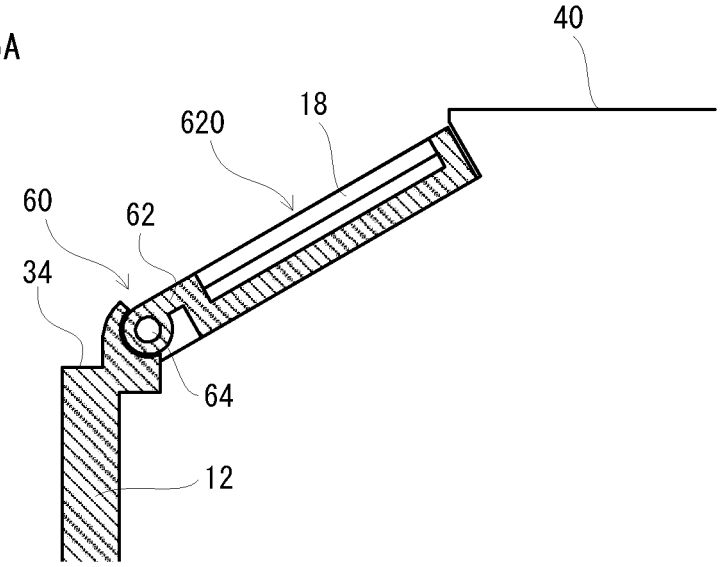
FIG. 5A is a schematic sectional view showing a case where an operating panel according to a third embodiment is in a basic state.
Figure 5B:
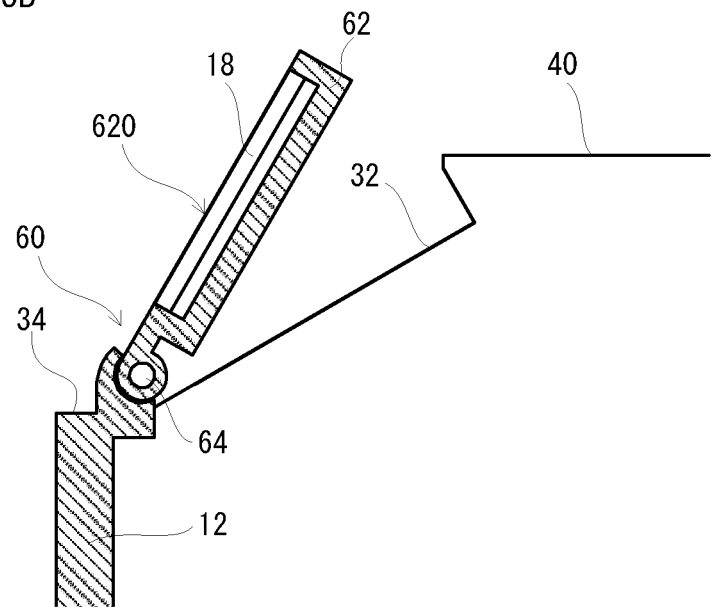
FIG. 5B is a schematic sectional view showing a case where a tilt angle of the operating panel according to the third embodiment is changed.

FIG. 5A is a schematic sectional view showing a case where an operating panel according to a third embodiment is in a basic state. FIG. 5B is a schematic sectional view showing a case where a tilt angle of the operating panel according to the third embodiment is changed. The operating panel 18 of the third embodiment can be changed (tiltable) in a tilt angle in the front and rear (up and down) direction. As shown in FIG. 5A, basically, the operating panel 18 is provided on the inclined portion 32 that descends toward the front side, and thus, in a state of slightly descending toward the front side (basic state).

As shown in FIG. 5A and FIG. 5B, the image forming apparatus 10 of the third embodiment is provided with a tilt mechanism 60 that supports the operating panel 18 tiltably. The tilt mechanism 60 includes a support member 62 and an axial member 64.

The support member 62 is a member that supports the operating panel 18. The support member 62 is formed in a shape of a laterally elongated substantially rectangular plate. A front end portion of the support member 62 is formed in a shape of a curved surface. Specifically, the front end portion of the support member 62 is formed in a shape of a semicircle, when viewed from the left and right direction. Moreover, the front end portion of the support member 62 is formed with a through hole that is extended in the left and right direction.

Moreover, a size in the left and right direction and a size in the front and rear (up and down) direction of the support member 62 are set to be larger than a size in the left and right direction and a size in the front and rear (up and down) direction of the operating panel 18, respectively. A concave portion 620 is formed on an upper surface of the support member 62. This concave portion 620 is formed in a shape of a laterally elongated substantially rectangular plate so as to correspond to an external shape of the operating panel 18. The operating panel 18 is fit in the concave portion 620 of the support member 62.

Moreover, in the third embodiment, a concave portion 320 that is formed in the inclined portion 32 is formed so as to correspond to an external shape of the support member 62. A front end portion of the concave portion 320 is formed in a shape corresponding to the front end portion of the support member 62. Specifically, the front end portion of the concave portion 320 is formed with a groove in a shape of semicircle when viewed from the left and right direction. However, a radius of the groove formed in the front end portion of the concave portion 320 is set to be slightly larger than a radius of the front end portion of the support member 62.

The axial member 64 is a columnar member extending in the left and right direction. Although illustration is omitted, both ends of a longitudinal direction of the axial member 64 are attached to the housing of the image forming apparatus 10.

The support member 62 is tiltably supported by inserting the axial member 64 into the through hole of the support member 62. Moreover, the support member 62 is rotated around an axis line of the axial member 64. However, the support member 62 is rotated by a manual operation by the user. As the support member 62 is rotated, the tilt angle of the operating panel 18 is changed.

As shown in FIG. 5A, the support member 62 is arranged so that the support member 62 is fit into the inclined portion 32, when the operating panel 18 is in the basic state.

However, the support member 62 is not rotated in a direction that the upper surface of the operating panel 18 faces toward an upper side (the end portion on the rear side moves toward the down side) compared to a case where the operating panel 18 is in the basic state. It is because the rotation of the support member 62 is regulated by the inclined portion 32. On the other hand, as shown in FIG. 5B, the support member 62 is tiltable in a direction that the upper surface of the operating panel 18 faces frontward (the end portion on the rear side moves toward the front side) compared to a case where the operating panel 18 is in the basic state.

Moreover, the image forming apparatus 10 of the third embodiment is provided with a retaining mechanism that retains the tilt angle of the support member 62 at an angle out of a plurality of stages. Although illustration is omitted, for example, as the retaining mechanism, it is possible to use a mechanism utilizing the elasticity of the support member 62 and the housing of the image forming apparatus 10 while forming concave-convex forms on the support member 62 and the housing of the image forming apparatus 10 (the end portion on the front side of the concave portion 320, etc.).

According to this third embodiment, since the tilt angle of the support member 62 supporting the operating panel 18 can be changed, it is possible to adjust the tilt angle of the operating panel 18 to an angle that the user can visually recognize. For example, when a user with low eyes level such as a wheelchair user or a child uses the image forming apparatus 10, it is possible to make a direction of the operating panel 18 correspond to the eyes level of the user.

In addition, it is possible to adopt the configuration shown in the third embodiment in combination with the second embodiment.

Moreover, although the rear end portion of the operating panel 18 is made to be located on the rear side compared to the front end portion of the image reading portion 14 in the above-described embodiment, it does not need to be limited to this. The front end portion of the operating panel 18 may be made to be located on the front side compared to the front end portion of the image reading portion 14. In this way, it becomes easy to visually recognize the operating panel 18.

Furthermore, although the flat portion 34 is provided on the front side of the operating panel 18 in the above-described embodiment, it does not need to be limited to this. The flat portion 34 may not be provided. In this way, it is possible to miniaturize of the image forming apparatus 10 in the front and rear direction.

Furthermore, although it is made for the operating panel 18 to include the display 52 with touch panel 50 in the above-described embodiment, it does not need to be limited to this. The operating panel 18 may include a hardware key(s) (key provided as a physical device) instead of or in addition to the display 52 with touch panel 50.

As described above, although the present invention has been described with reference to specific embodiments, the present invention is not limited to the above-described embodiments. It should be noted that the above-described specific embodiments are all mere examples, and to be changed appropriately in accordance with specifications of the actual products.

Although the present invention has been described and illustrated in detail, it is clearly understood that the same is by way of illustration and example only and is not to be taken by way of limitation, the spirit and scope of the present invention being limited only by the terms of the appended claims. Furthermore, it is intended that the scope of the present invention covers all modifications within the meaning and range of equivalency of the claims.

What is claimed is:

1. An in-body sheet discharge type image forming apparatus having an image forming portion and an image reading portion that is arranged above the image forming portion, the image forming apparatus comprising:

a sheet discharge tray provided between the image forming portion and the image reading portion, the sheet discharge tray including a sheet placement surface onto which a recording medium having been formed with an image by the image forming portion is discharged; and an operating panel provided on a front side of the sheet discharge tray, the operating panel including a display that displays one or more keys that receive an input operation, wherein the operating panel is arranged below the sheet placement surface of the sheet discharge tray; and a part of the operating panel overlaps with the recording medium discharged onto the sheet placement surface of the sheet discharge tray.

2. The image forming apparatus according to claim 1, wherein a front end portion of the sheet discharge tray is located rearward of a front end edge of the recording medium discharged onto the sheet placement surface of the sheet discharge tray.

3. The image forming apparatus according to claim 1, wherein the operating panel is provided on a front descending inclined portion formed between the sheet placement surface of the sheet discharge tray and the image forming portion.

4. The image forming apparatus according to claim 1, wherein the sheet discharge tray has a protruding portion that protrudes toward a front side compared to a rear end portion of the operating panel, the protruding portion being arranged above the operating panel.

5. The image forming apparatus according to claim 4, wherein a front end portion of the protruding portion is located on a rear side compared to the display when the display is viewed from a direction perpendicular to an upper surface of the display.

6. The image forming apparatus according to claim 1, wherein the operating panel is arranged on a downstream side in a sheet discharge direction on the front side of the sheet discharge tray.

7. The image forming apparatus according to claim 1, wherein a rear end portion of the operating panel is located on a rear side compared to a front end portion of the image reading portion.

8. The image forming apparatus according to claim 1, further comprising a flat portion that is provided on a front side of the operating panel.

9. The image forming apparatus according to claim 1, further comprising a tilt mechanism that supports the operating panel tiltably.

* * * * *